US008622009B2

(12) United States Patent
Wacker et al.

(10) Patent No.: US 8,622,009 B2
(45) Date of Patent: Jan. 7, 2014

(54) LOCKING MECHANISM FOR A BOBBIN CASE

(75) Inventors: Niklaus Wacker, Steckborn (CH); Heinz Janouschek, Steckborn (CH); André Stucki, Steckborn (CH)

(73) Assignee: BERNINA International AG, Steckborn (CH)

( * ) Notice: Subject to any disclaimer, the term of this patent is extended or adjusted under 35 U.S.C. 154(b) by 89 days.

(21) Appl. No.: 13/315,621

(22) Filed: Dec. 9, 2011

(65) Prior Publication Data

US 2012/0145059 A1 Jun. 14, 2012

(30) Foreign Application Priority Data

Dec. 9, 2010 (CH) ..... 2061/10

(51) Int. Cl.
*D05B 57/26* (2006.01)

(52) U.S. Cl.
USPC ..... 112/231

(58) Field of Classification Search
USPC ..... 112/180, 188, 231; 242/124, 170, 137
See application file for complete search history.

(56) References Cited

U.S. PATENT DOCUMENTS

| | | | | | |
|---|---|---|---|---|---|
| 388,323 | A * | 8/1888 | Vannett | 112/231 |
| 832,414 | A * | 10/1906 | Porter | 112/180 |
| 2,813,500 | A * | 11/1957 | Goosman et al. | 112/231 |
| 3,323,743 | A * | 6/1967 | Landgraf | 242/586.2 |
| 3,381,643 | A * | 5/1968 | Meloy, Jr. | 112/231 |
| 5,960,728 | A * | 10/1999 | Hirose | 112/231 |
| 7,036,444 | B2 * | 5/2006 | Fluckiger | 112/231 |
| 2010/0206207 | A1 * | 8/2010 | Fluckiger et al. | 112/231 |
| 2012/0145059 | A1 * | 6/2012 | Wacker et al. | 112/231 |

FOREIGN PATENT DOCUMENTS

EP 1541736 5/2008

* cited by examiner

*Primary Examiner* — Danny Worrell
(74) *Attorney, Agent, or Firm* — Volpe and Koenig, P.C.

(57) ABSTRACT

A locking mechanism for a bobbin case (5) is provided with a locking lever (35) supported pivotally in the bobbin cover (27). The locking lever is pivotal on a shaft (33). A hook-shaped end (51) is formed at the locking lever (35), which latches in the sleeve (9) in the hook and can hold the bobbin case (3) in the hook (1).

4 Claims, 7 Drawing Sheets

LOCKING MECHANISM FOR A BOBBIN CASE

CROSS-REFERENCE TO RELATED APPLICATIONS

This application claims the benefit of Swiss Patent Application No. 02061/10, filed Dec. 9, 2010, which is incorporated herein by reference as if fully set forth.

BACKGROUND

The invention is directed to a locking mechanism for a bobbin case for a lower thread bobbin.

The lower thread bobbin of sewing machines, particularly household sewing machines, can be supported directly in the bobbin carrier and thus be directly accessible. However, it may also be inserted into a bobbin case designed for said purpose, which in turn is supported in the bobbin carrier. The present invention relates to a lower thread bobbin supported in a bobbin case.

A locking mechanism for a lower thread bobbin is known from EP 1541736 B1, in which on the bobbin case a locking mechanism that can be guided through the central opening in the bobbin is held on a spring and after the complete pressing down of the bobbin into the bobbin carrier, the bobbin automatically latches. The latter can be released from this latching by a radial displacement of the locking element towards the rotary axis of the bobbin. Then the bobbin case is ejected by the spring supporting the locking element.

SUMMARY

The objective of the present invention is to provide a locking mechanism for a bobbin case used for a lower thread bobbin, by which the bobbin case latches in the bobbin carrier and is securely held there in all operating conditions. Additionally, an axial shifting of the bobbin case together with the bobbin out of the bobbin carrier shall be achieved after the release.

This objective is attained by a locking mechanism according to the invention. Advantageous embodiments of the invention are described in greater detail below and in the claims.

By a radially extending pressure upon the locking element provided in the surface of the bobbin case the fastened position, which holds the bobbin in the hook, can be released and simultaneously the partial ejection of the bobbin case with the bobbin can be initiated. The locking of a new bobbin case with a bobbin to be inserted in the hook occurs by an axial insertion of the bobbin case into the hook until it is completely located inside the recess of the hook. Here, no additional locking actions are required. During the sewing operation the bobbin held by the locking element is not restricted in any way by said locking element because the latter is not in contact with the bobbin in the operating state. When inserting the bobbin into the bobbin case, the case is held in a force-fitting manner by the locking element so that when inserting the bobbin case with the bobbin into the hook the bobbin cannot fall out of the bobbin case. During unlocking for the purpose of removing the bobbin case from the hook the bobbin located in the bobbin case is held by the locking element, as long as it is in operation, and the bobbin case can be removed from the hook without any additional manipulation.

BRIEF DESCRIPTION OF THE DRAWINGS

The invention is explained in greater detail using an illustrated exemplary embodiment. Shown are.

DETAILED DESCRIPTION OF THE PREFERRED EMBODIMENT

Figure 1:
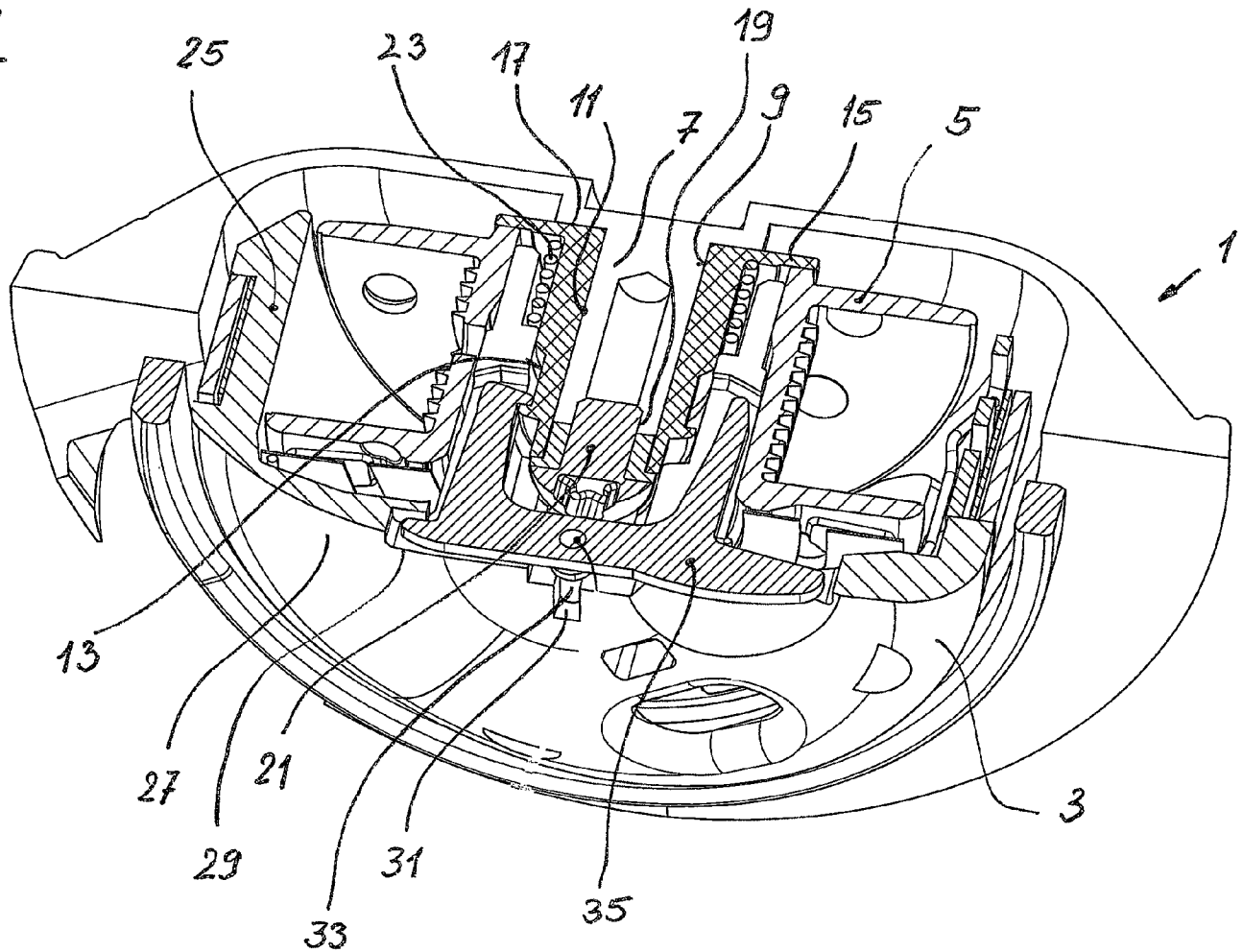
FIG. 1 is an axial cross-sectional view through a hook with an inserted bobbin case and bobbin.

In FIG. 1, showing an axial cross-section through a hook 1 with a bobbin case 3 inserted therein and a bobbin 5 arranged in the bobbin case 3, all features relevant for the invention are discernible. A sleeve 9 rests on an arbor 7 formed in the hook 1. The sleeve 9 comprises a central cylindrical section 11, with a circumferential clearance groove 13 being embodied at its periphery, with one side extending approximately perpendicular in reference to the axis of the sleeve 9 and its second side having an angle of approx. 45°. The lower end of the sleeve 9 is closed by a flange 15, which in turn abuts at one side a collar 17 at the hook 1 and at the other side radially projects the collar 17. The end of the sleeve 9 opposite the flange 15 comprises, for example, an interior diameter greater than the interior diameter of the sleeve in the other sections. Using a screw 21 engaging the arbor 7 and here engaging a threaded bore 19 the sleeve 9 is held at the arbor 7. The sleeve 9 may represent an integral part of the hook 1, i.e. not embodied as an element mounted thereon.

A coil spring 23 is placed onto the sleeve 9 and supported and fixed at one side at the flange 15.

Figure 5:
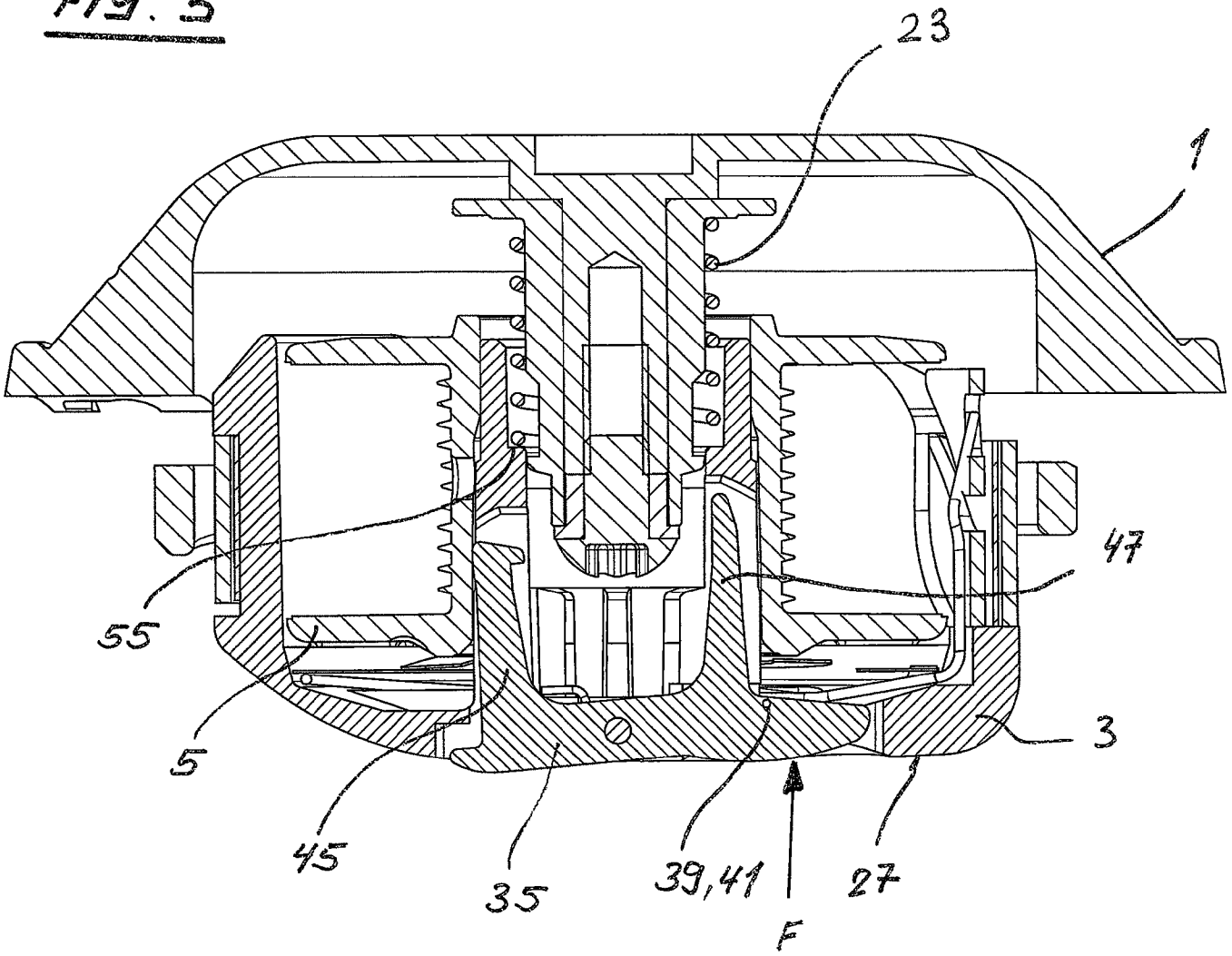
FIG. 5 is an axial cross-sectional view through the bobbin case, with the locking mechanism unlatched, and the bobbin case exiting.

The bobbin case 3 comprises a casing 25 and, in FIG. 1 at the front, a cover 27 spherically shaped at the outside. This transfers arc-shaped into the casing 25. A slot-shaped opening 29 is provided in the cover 27, extending diagonally, and a recess 31, extending perpendicular in reference to the opening 29, and not completely penetrating the cover 27. A shaft 33 is located in the recess 31, which penetrates a two-arm locking lever 35. The locking lever 35 is located in a slot-shaped opening 29. A torsion spring 37 (shown only partially) encompasses the shaft 33 and contacts with its first end the interior of the cover 27; its second end 39 penetrates the locking lever 35 in a bore 41 or contacts it at the outside (cf. FIG. 5).

Figure 2:
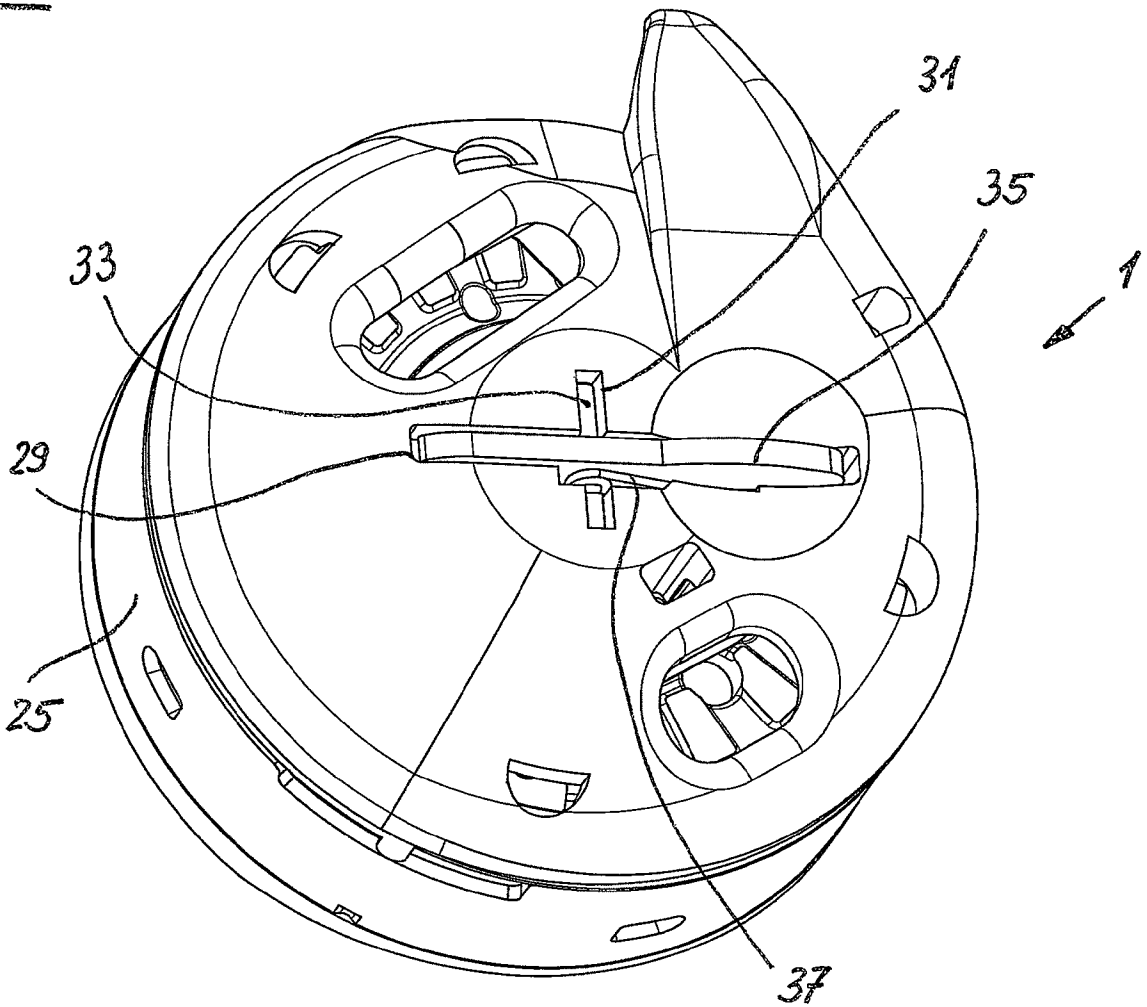
FIG. 2 is a perspective view of a bobbin case at the side of the lid.
Figure 3:
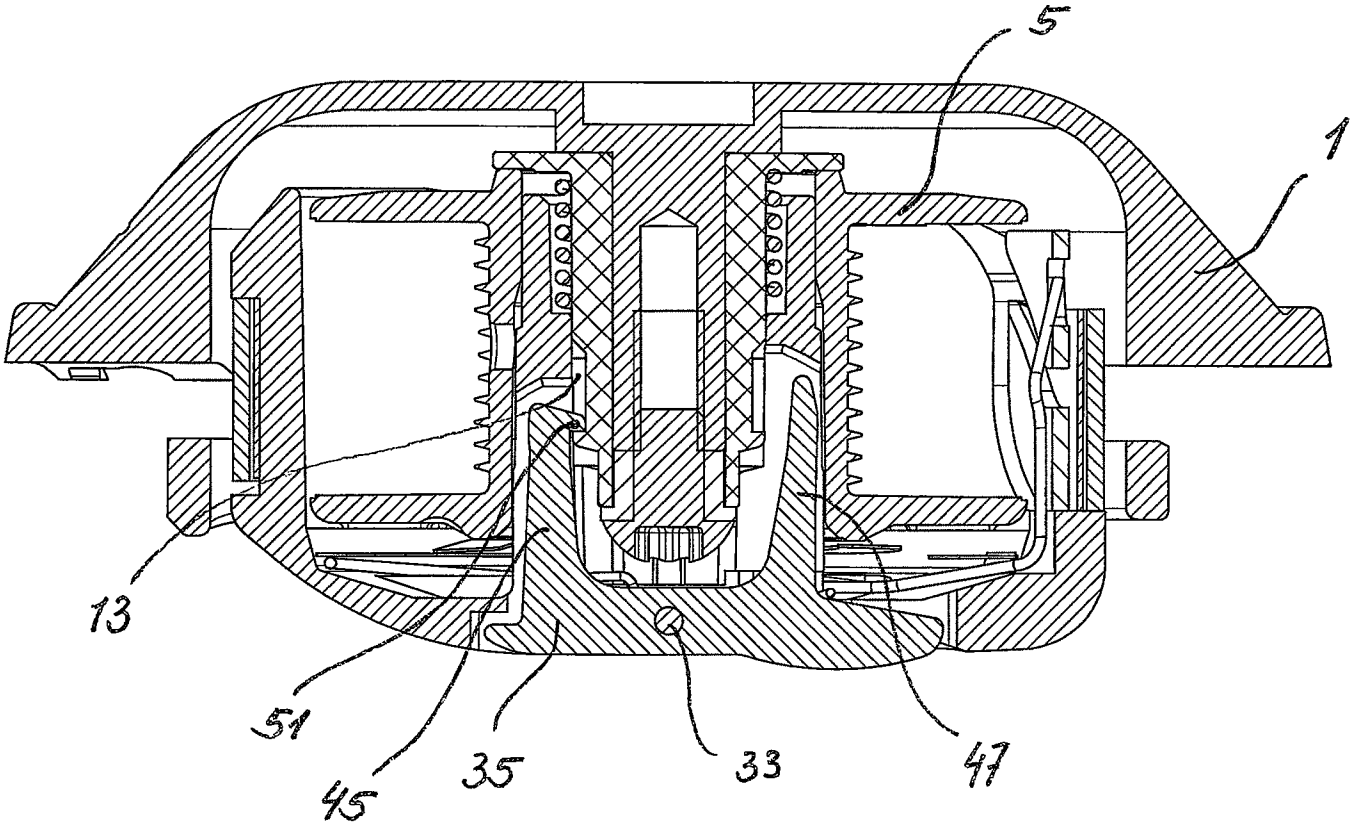
FIG. 3 is an axial cross-sectional view through the bobbin case including the inserted bobbin, with the locking mechanism being engaged.
Figure 4:
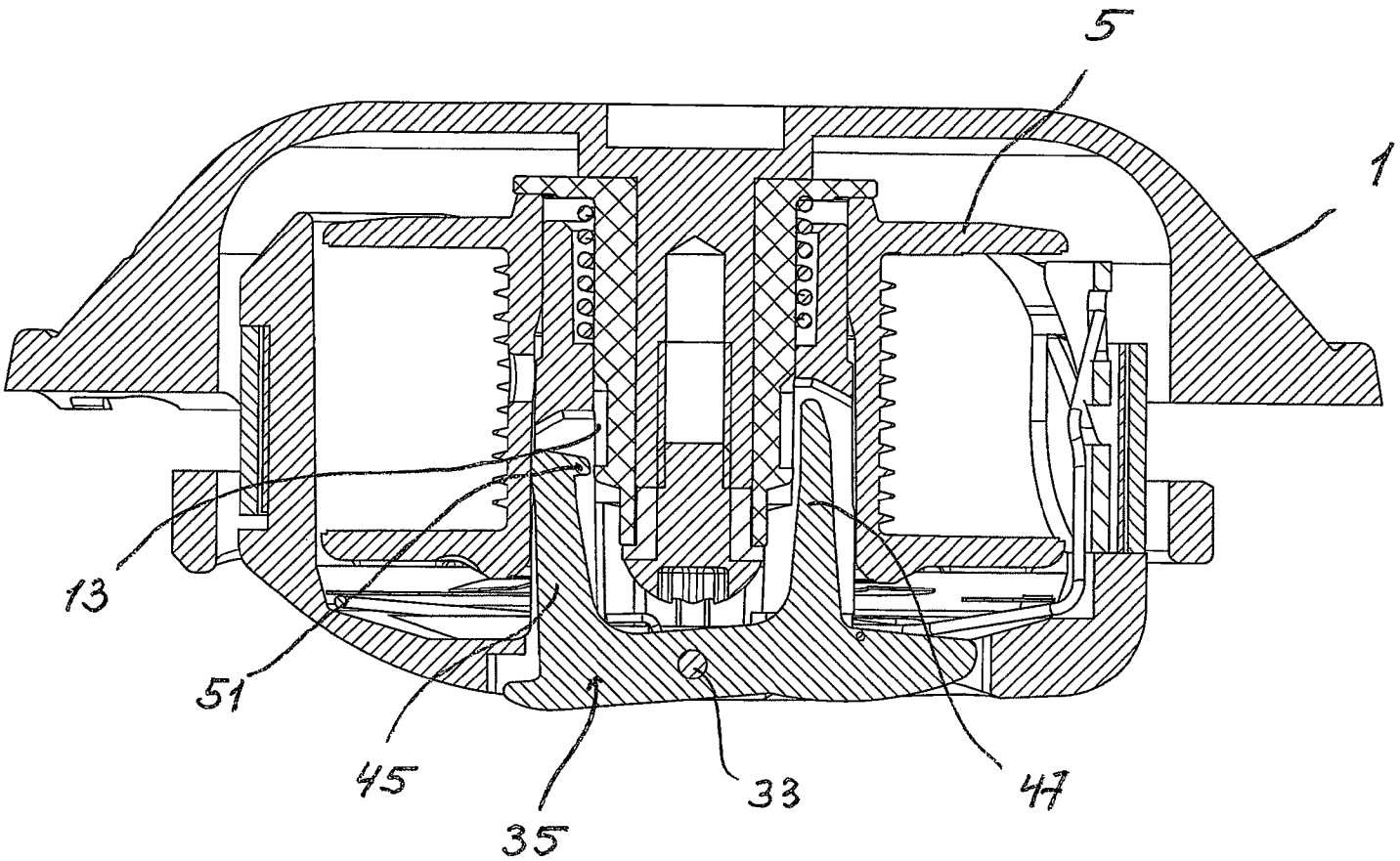
FIG. 4 is an axial cross-sectional view through the bobbin case directly before the bobbin case is latched.
Figure 6:
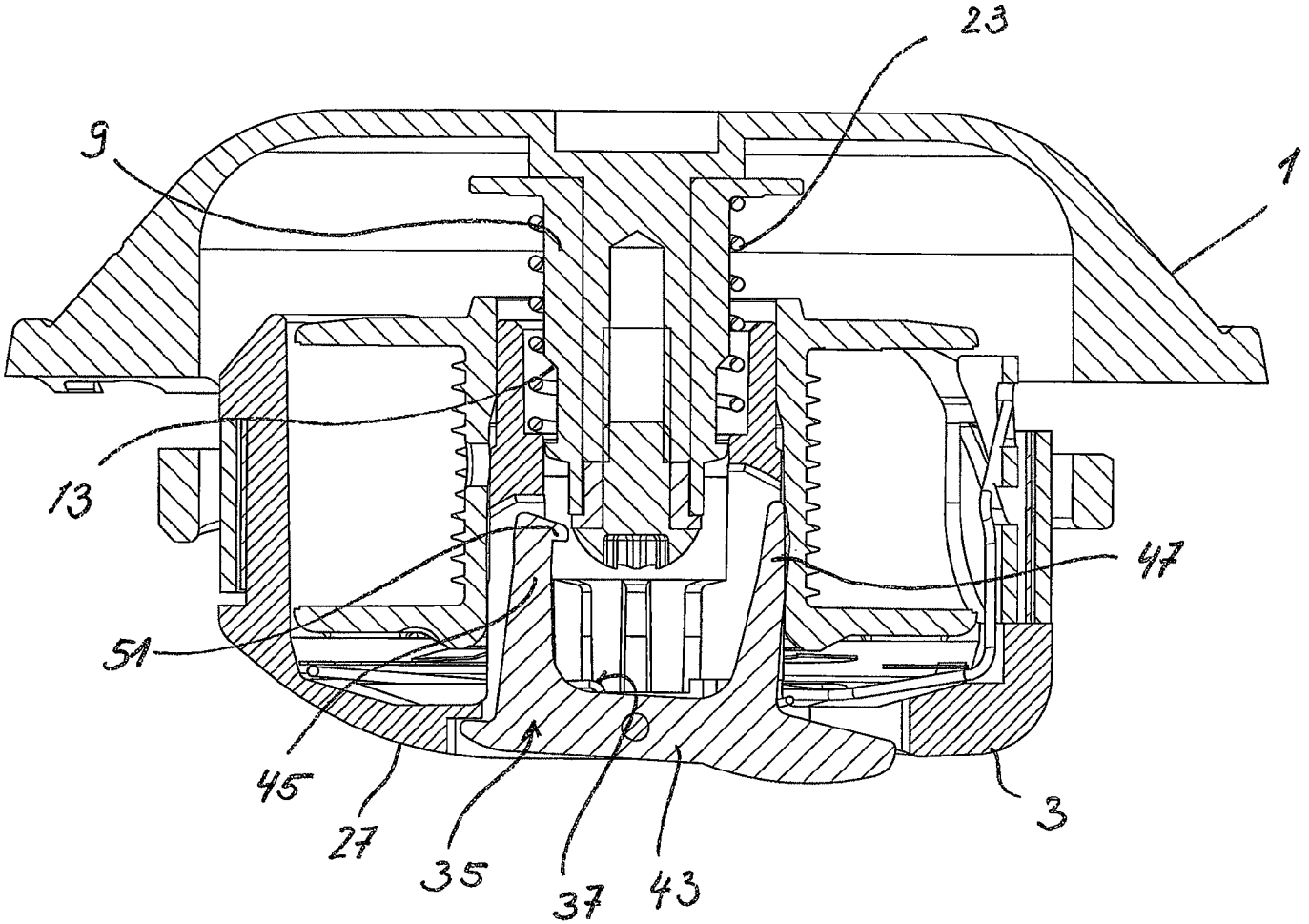
FIG. 6 is an axial cross-sectional view through a bobbin case with a locking element in the position holding the bobbin, during the insertion into the hook.

Arranged asymmetrically in reference to the shaft 33, the locking lever 35 comprises one latching leg 45 projecting essentially perpendicularly from the primary leg 43, which extends parallel to the cover 27 and, at a distance therefrom, one braking leg 47. It is further discernible from FIGS. 1 and 2 that a recessed grip 49 is provided in the cover 27 of the bobbin 5, allowing for pushing down the locking lever 35 on the shaft 33 using a finger and thus pivoting it so that the hook-shaped end 51 at the latching leg 45 can be released from its spring-loaded latching position in the clearance groove 13. In the pivoted and released position the back of the latching leg 45 contacts the wall of the bore 53 in the bobbin 5 in a friction-fitting manner. Immediately after the pivoting of the locking lever 35 the bobbin case 3 is axially ejected out of the hook 1 by the tension force of the coil spring 23, because the second end of the spring 23 contacts a stop 55 in the bobbin case 3 (cf. FIG. 5). The bobbin case 3 can now manually be removed from the hook 1. Here, the bobbin 5 is held in a friction-fitting fashion by the back of the latching leg 45 of the locking lever 35. As soon as the force F upon the locking lever 35 reduces, i.e. when the operating person grasps the bobbin case peripherally with two fingers, locking lever 35 rotates in the clockwise direction and holds the bobbin 5 via the back of the braking leg 47 (cf. FIG. 6).

Figure 7:
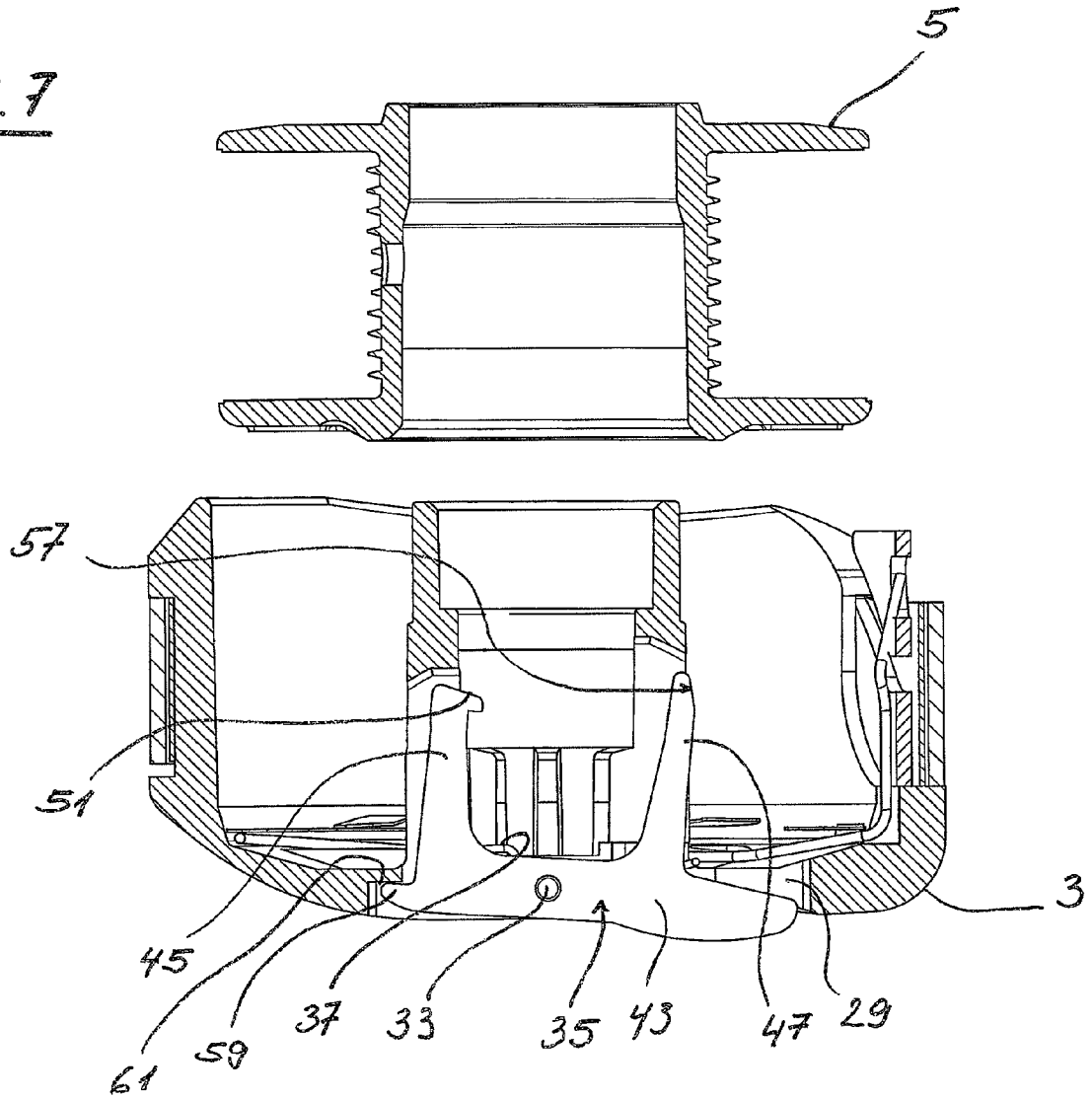
FIG. 7 is a view of a bobbin case without a bobbin and with the bobbin being removed.

It is discernible from FIG. 7 that the latching leg 45 is pivoted in the clockwise direction to the very right by the force of the torsion spring 37 and contacts a cam-shaped end 59 embodied on the primary leg 43 at a stop 61 in the opening 29.

A refilled lower thread bobbin 5 is inserted from above into the bobbin case 3. Here, it glides against a certain resistance over the angled surface 57 of the braking leg 47 of the locking lever 35 downwards and is here held in position by the back of the brake leg 47. Thus, when inserting the bobbin case 3 into the hook 1 this way the bobbin 5 is held and cannot fall out, even when the bobbin case 3 is tilted slightly downwards. As soon as the hook-shaped end 51 of the latching leg 45 contacts the sleeve 9 the locking lever 35 is slightly pivoted in the counter-clockwise direction. During the further insertion the hook-shaped end 51 glides along the casing of the sleeve 9 until the hook-shaped end 51 reaches the clearance groove 13 and can latch here. Now, the bobbin case 3 including the bobbin 5 is held in the hook 1 and cannot fall out of it any more. Both the latching leg 45 as well as the braking leg 47 are located in the latched position at a distance from the interior wall of the bore in the bobbin 5. Thus, the latter is held freely rotational. In this position the exterior surface of the primary leg 43 is also located below the exterior contour of the cover 27.

LIST OF REFERENCE CHARACTERS

1 hook
3 bobbin case
5 bobbin
7 arbor
9 sleeve
11 cylindrical section
13 clearance groove
15 flange
17 collar
19 threaded bore
21 screw
23 helical spring
25 casing of 3.
27 cover
29 opening
31 recess
33 shaft
35 locking lever
37 torsion spring
39 end of 37
41 bore
43 primary leg
45 latching leg
47 braking leg
49 recessed grip
51 hook-shaped end
53 bore
55 recess
57 angled surface
59 end of 43
61 stop

The invention claimed is:

1. A locking mechanism for a bobbin case for a lower thread bobbin to be received in a hook for a sewing machine, comprising:

a bobbin case with a cover, a locking element to hold the bobbin case in the hook, a spring located on an arbor in the hook to eject the bobbin case with the bobbin from the hook, the cover of the bobbin case having a slot-shaped opening and a pivotally supported, two-arm locking lever arranged in the slot-shaped opening, the two-arm locking lever having a latching leg with a hook-shaped end adapted to engage a clearance groove in the bobbin arbor when the bobbin case is inserted into the hook against a force of the spring, the locking lever including a bore that is penetrated by a shaft, said shaft being located in a recess located on an outside of the cover and extending perpendicular to the slot-shaped opening, and being held in the cover by a torsion spring encompassing the shaft.

2. The locking mechanism according to claim 1, wherein the clearance groove is provided in a sleeve placed upon the bobbin arbor and at one end of the sleeve a flange is formed to support the spring encompassing the sleeve.

3. The locking mechanism according to claim 2, wherein a braking leg is located on the locking lever and, based on a pivotal force of the torsion spring placed upon the shaft, a back of the braking leg contacts a wall of a bore in a bobbin inserted in the bobbin case to hold the bobbin in a friction-fitting fashion during a removal of the bobbin case from the hook and during an insertion into the hook.

4. The locking mechanism according to claim 1, wherein a recessed grip is provided in the cover, which is intersected by a primary leg of the locking lever and which is adapted to allow a pushing down and a pivoting of the locking lever.

* * * * *